United States Patent [19]

Kawaguchi

[11] Patent Number: 4,675,636

[45] Date of Patent: Jun. 23, 1987

[54] SUPERCONDUCTING MAGNET

[75] Inventor: Takeo Kawaguchi, Kobe, Japan

[73] Assignee: Mitsubishi Denki Kabushiki Kaisha, Tokyo, Japan

[21] Appl. No.: 868,108

[22] Filed: May 29, 1986

[30] Foreign Application Priority Data

Jun. 3, 1985 [JP] Japan ..... 60-118856

[51] Int. Cl.[4] ..... H01F 7/22

[52] U.S. Cl. ..... 335/216; 174/15 CA; 356/DIG. 1

[58] Field of Search ..... 335/216, 299; 174/126 S, 128 S, 15; 336/DIG. 1

[56] References Cited

U.S. PATENT DOCUMENTS 4,599,592 7/1986 Marsing ..... 335/216

FOREIGN PATENT DOCUMENTS 56-12756 8/1982 Japan ..... 335/216

OTHER PUBLICATIONS

"A Low-Heat-Leak Support Structural Member for the Superconducting Chicago Cyclotron Magnet, Leung et al., *Advances in Cryogenic Engineering, vol. 27, pp. 193-200, 1982.*

*Primary Examiner*—George Harris

*Attorney, Agent, or Firm*—Leydig, Voit & Mayer

[57] ABSTRACT

A superconducting magnet comprising a superconducting coil disposed in an insulation housing, a heat insulation support rod for supporting said superconducting coil against a room temperature wall of the insulation housing, a heat insulation plate disposed on a side of the superconducting coil, and a thermal anchor inserted between said insulation rod and said superconducting coil and carrying a cooling pipe to provide a path for a refrigerant carrier to flow through. The heat insulation plate has a higher heat resistance than that of the thermal anchor to reduce the influent heat from the room temperature wall to the superconducting coil so as to improve performance of the superconducting magnet.

2 Claims, 5 Drawing Figures

SUPERCONDUCTING MAGNET

BACKGROUND OF THE INVENTION

The present invention relates to a superconducting magnet and more particularly to an improved heat insulation support structure for a superconducting magnet.

A conventional heat insulation support structure for a superconducting magnet is shown in FIG. 1.

FIG. 1 shows in partial section a heat insulation support structure which is disclosed for example, in "A low heat leak support structural member for the superconducting Chicago Cyclotron Magnet" published in *Advances in Cryogenic Engineering* Vol. 27 (1982) pp 193–200, wherein a superconducting coil 1 is supported by a heat insulation support rod 5 against a room temperature wall of an insulation housing. The heat insulation support rod 5 is constructed of heat insulation support members 3*a*, 3*b* and a thermal anchor 4 inserted therebetween. A cooling pipe 4*a* is provided on the thermal anchor 4.

The heat insulation support members 3*a*, 3*b* and the thermal anchor 4 are thermally and mechanically connected to each other to form a heat insulation support rod 5, by means of which the superconducting coil 1 is supported against the room temperature wall 2 of an insulation housing 2*a* so as to be thermally insulated. Since the room temperature wall 2 is at a room temperature (300° K.) and the superconducting coil 1 is at a cryogenic temperature (4.2° K.), heat is transferred from the insulation housing to the superconducting coil 1 by way of the heat insulation support rod 5. In order to reduce this flow of heat, the heat insulation support members 3*a*, 3*b* are made of a material whose heat transfer coefficient is small, and the length L2 of these members is made as long as possible. Also, the flow of liquid nitrogen (whose temperature is at 78° K.) through the cooling pipe 4*a* provided on the thermal anchor 4 further reduces the influent heat 91 to the superconducting coil 1.

FIG. 2 is a heat circuit diagram of the heat insulation support structure.

In the heat insulation support structure for the conventional superconducting magnet constructed above, it is necessary that the heat transfer coefficient of the heat insulation support members be lower and the length thereof be longer to minimize the influent heat to the superconducting coil. However, there are certain limitations in minimizing the influent heat due to the spatial distance between the normal temperature wall and the superconducting coil. As a result, in indirect cooling type superconducting magnets, the temperature of the superconducting coil rises due to the influent heat from the heat insulation support rod, thereby deteriorating the performance of the superconducting magnet.

SUMMARY OF THE INVENTION

The present invention has been made in order to eliminate the aforesaid problem and has for its object to provide a superconducting magnet in which there is less influent heat to the superconducting coil.

The superconducting magnet according to the present invention includes a superconducting coil supported by the heat insulation support rod against the room temperature wall of the insulation housing a heat insulation plate and a thermal anchor disposed between the heat insulation support rod and the superconducting coil.

The heat insulation plate and the thermal anchor according to the present invention have large heat resistance, so that the influent heat through the heat insulation support rod from the normal temperature wall of the vessel to the superconducting coil is reduced, thereby decreasing the amount of influent heat to the superconducting magnet.

BRIEF DESCRIPTION OF THE DRAWINGS

In the drawings, the same reference numerals indicate the same or corresponding parts.

DESCRIPTION OF THE PREFERRED EMBODIMENT

The present invention will become clear from the following description in which the preferred embodiment has been set forth in detail in reference to the accompanying drawings.

Figure 1:
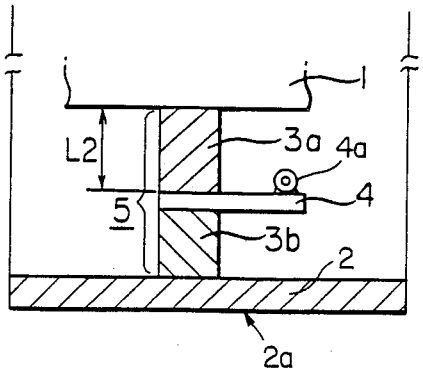
FIG. 1 PRIOR ART
FIG. 1 is a partial sectional view of a heat insulation support structure of the conventional superconducting magnet.
Figure 2:
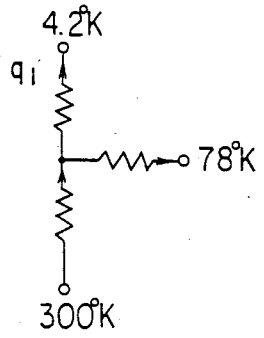
FIG. 2 PRIOR ART
FIG. 2 is a heat circuit diagram of the heat insulation support structure shown in FIG. 1.
Figure 3:
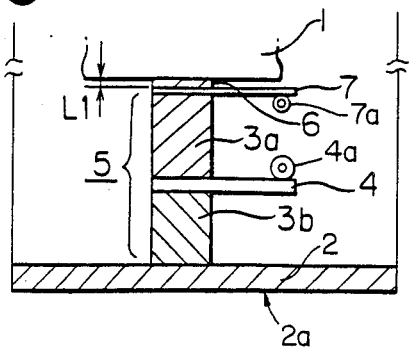
FIG. 3 is a partial sectional view of a heat insulation support structure of one embodiment of the superconducting magnet according to the present invention.

As will be seen in FIG. 3, the superconducting magnet according to the present invention comprises a superconducting coil supported by a heat insulation support rod 5, this rod comprising heat insulation support members 3*a*, 3*b* and a thermal anchor 4 against the room temperature wall 2 of the insulation housing 2*a*. This is the same construction as that of the conventional superconducting magnet. Further provided in the present invention is a heat insulation plate 6 and a thermal anchor 7 inserted between the heat insulation support rod 5 and the superconducting coil 1. As shown in FIG. 3, the heat insulation plate 6 is on the side of the superconducting coil 1 and the thermal anchor 7 is on the side of the heat insulation support rod 5.

The thermal anchor 7 is provided with a cooling pipe 7*a* through which a refrigerant carrier passes so that the portion of the thermal anchor 7 on which the cooling pipe 7*a* is disposed is maintained at substantially the same temperature as that of the superconducting coil 1.

Figure 4:
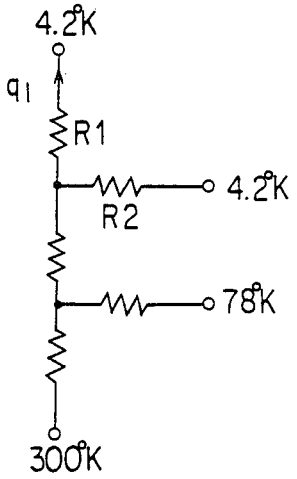
FIG. 4 is a heat circuit diagram of the heat insulation support structure of FIG. 3

FIG. 4 is a heat circuit diagram of the heat insulation support structure according to the present invention in which symbol R1 designates heat resistance of the heat insulation plate 6, R2 heat resistance of the thermal anchor 7, 91 influent heat to the superconducting coil 1, respectively.

Figure 5:
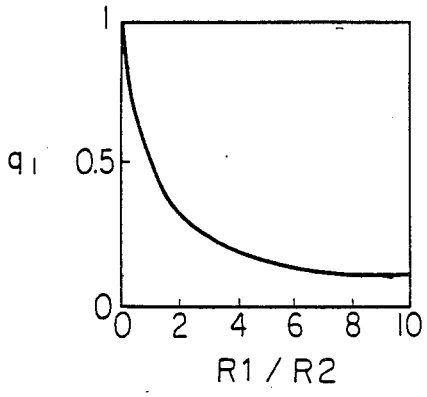
FIG. 5 is a graph illustrating the relationship between the heat resistance ratio and the influent heat in the present invention.

FIG. 5 is a graph showing the relationship between the heat resistance ratio R1/R2 and the influent heat 91 to the superconducting coil. It is noted that the heat resistance R of an insulating plate is directly proportional to the length thereof, i.e., the longer the plate, the higher the heat resistance R. Therefore, if the ratio R1/R2 is made larger, i.e., a heat insulation plate 6 whose heat resistance is larger than that of the thermal anchor 7 is used, the influent heat 91 to the superconducting coil 1 is considerably reduced. The thermal anchor 7 is made of a metal whose heat transfer coefficient is large. Therefore, even if the length L1 of the heat insulation plate 6 is reduced, the heat resistance ratio R1/R2 becomes larger. Even if the spatial distance between the superconducting coil 1 and the room temperature wall 2 is small, the influent heat to the superconducting coil can be decreased.

In the above preferred embodiment, the heat insulation support rod, the thermal anchor, the heat insulation plate are shaped as shown in the figures, but differently shaped members can still provide the same effect.

Thus, the superconducting magnet according to the present invention is constructed of a thermal anchor which is thermally connected to the refrigerant carrier and a heat insulation plate between the heat insulation support rod and the superconducting coil, thereby resulting in a decrease in the influent heat to the superconducting coil and an increase in the performance of the superconducting magnet.

What is claimed is:

1. A superconducting magnet comprising a superconducting coil disposed in an insulation housing, a heat insulation support rod for supporting said superconducting coil against a room temperature wall of the insulation housing, a heat insulation plate disposed on a side of the superconducting coil, and a thermal anchor inserted between said insulation rod and said superconducting coil and carrying a cooling pipe to provide a path for a refrigerant carrier to flow through, whereby influent heat from the room temperature wall to said superconducting coil is substantially reduced to improve performance of said superconducting magnet.

2. A superconducting magnet as claimed in claim 1 wherein said heat insulation plate has higher heat resistance than that of said thermal anchor.

* * * * *